United States Patent [19]

Pech et al.

[11] 4,247,263

[45] Jan. 27, 1981

[54] PUMP ASSEMBLY INCORPORATING VANE PUMP AND IMPELLER

[75] Inventors: Karl H. Pech, Simsbury; George W. Jahrstorfer, S. Windsor, both of Conn.

[73] Assignee: Chandler Evans Inc., W. Hartford, Conn.

[21] Appl. No.: 747,501

[22] Filed: Dec. 6, 1976

[51] Int. Cl.[3] ..... F04B 23/14; F01C 1/00; F04B 49/00

[52] U.S. Cl. ..... 417/203; 417/294; 417/295; 417/310; 418/40; 418/82; 418/152; 418/177

[58] Field of Search ..... 417/201, 202, 283, 284, 417/294, 295, 203, 310; 418/40, 82, 152, 177, 268

[56] References Cited

U.S. PATENT DOCUMENTS 3,279,387 10/1966 McGill ..... 418/267

*Primary Examiner*—Richard E. Gluck

*Attorney, Agent, or Firm*—Radford W. Luther; Richard A. Dornon

[57] ABSTRACT

A fuel pump assembly for supplying fuel to a gas turbine engine has a centrifugal pump, including an impeller, that furnishes the necessary pressure for engine operation at high engine speeds. A vane pump, attached to the back side of the impeller of the centrifugal pump, supplies fuel to the engine for starting and acceleration to idle. The vane pump is of the type having a stationary centrally disposed cam and an annular rotor with radially inwardly directed vanes which ride over the surface of the cam. Before idle speed is attained, the vanes which are substantially hydraulically balanced and made of a light plastic material are adapted to lift off the surface of the cam without the need of pressure relief behind the vanes.

6 Claims, 8 Drawing Figures

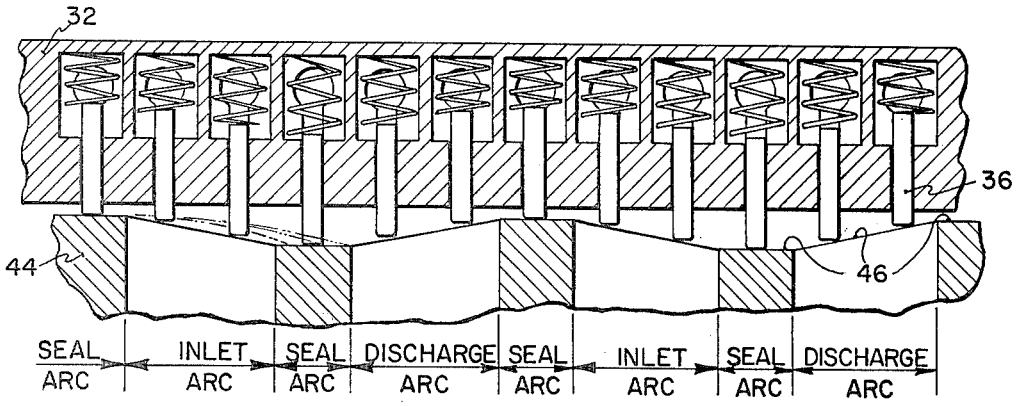
Fig. 5
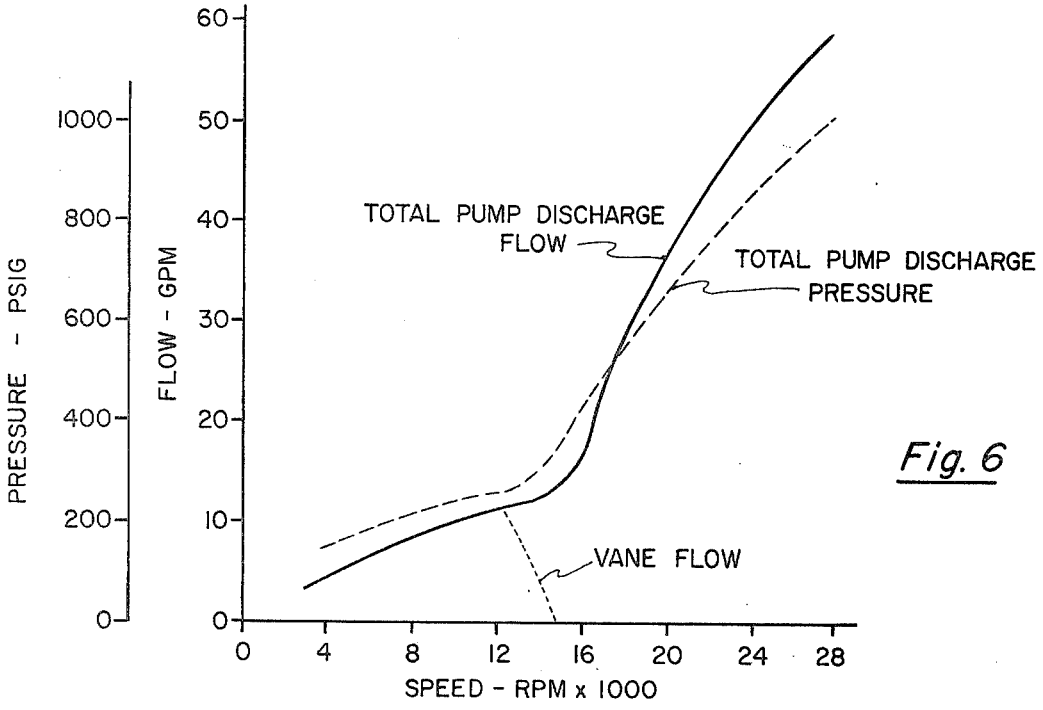
Fig. 6
Fig. 2A
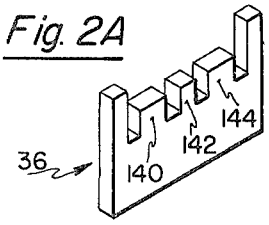

PUMP ASSEMBLY INCORPORATING VANE PUMP AND IMPELLER

BACKGROUND OF THE INVENTION

This invention relates to pumping systems.

A conventional fuel control system for a gas turbine engine comprises an engine driven main fuel pump and a metering control adapted to sense various engine parameters for controlling the rate of fuel flow to the engine's combustion chambers in accordance therewith. Main fuel pumps and existing fuel control systems are generally fixed displacement gear pumps or vane pumps which provide output flows which exceed engine fuel requirements under certain conditions (e.g., high altitude operations). Such main fuel pumps, therefore, necessitate the bypassing of fuel which engenders fuel heating, impairs pumping efficiency and creates other problems such as detracting from the ability of the fuel to cool engine accessories and oil and hydraulic systems without exceeding a maximum safe engine temperature at the burner nozzles.

In order to prevent excessive fuel heating in a bypass loop, various alternative schemes have been proposed or utilized to solve the fuel temperature increase problem. One such problem is the utilization of a variable delivery fuel pump which may be constituted by a positive displacement pump or an impeller pump. If a centrifugal pump alone is employed as the main pumping element in a fuel control system, starting flow requirements mandate that it be of a size sufficient to generate the necessary pressure at low engine speeds and thus at high engine speeds, the generated pressure may be excessive. Also, a centrifugal pump alone is not capable of furnishing the dry lift essential to the proper starting operation of most fuel control systems. The latter considerations therefore normally render a positive displacement pump an indispensable component of the fuel control system.

U.S. Pat. No. 3,851,998 is directed toward a fuel pump assembly for a gas turbine engine incorporating a positive displacement vane pump and a centrifugal pump. In the pump assembly of the patent, the vane pump supplies fuel from start to acceleration to idle speed and the centrifugal pump supplies fuel to the gas turbine engine thereafter. The vane pump disclosed in the patent is of the type having a stationary centrally disposed cam and an annular rotor with radially inwardly directed vanes. High pressure is maintained behind the vanes to prevent the centrifugal forces acting on each of the vanes from moving them radially outwardly and thereby unloading the vane pump. As idle engine speed is approached, internal valving relieves the high pressure behind the vanes, thereby quickly permitting the centrifugal force to overcome the spring load on the vanes and cause them to be retracted to an inoperative position where they do not engage the cam surface. A difficulty with a pump assembly, as illustrated in the aforementioned patent, is that the vanes are subjected to large bearing loads due to the high pressure urging them into engagement with the cam surface. Another drawback of the pump assembly shown in the patent is that valving must be provided, together with a suitable engine speed sensor, to vent the high pressure behind the vanes at the predetermined engine speed.

SUMMARY OF THE INVENTION

The pump assembly of the invention, while similar to the pump assembly shown in the aforementioned patent, provides for automatic deactivation of the high RPM vane pump of the type having a stationary centrally disposed cam and an annular rotor with radially inwardly directed vanes without the use of speed sensors and pressure relief valves. Also, in a pump of the invention, the vanes are subjected to minimum bearing loads because the ends of the vanes are fluidly interconnected and shaped to provide static hydraulic balance in a radial direction and to encounter minimal fluid resistance.

Briefly stated, in a pump assembly of the invention, the vanes are designed to lift off the cam surface over an inlet arc wherein the backs of the vanes are referenced to inlet pressure. Below deactivation RPM, the vanes re-engage the cam surface at the sealing arc between the discharge and inlet arcs. At deactivation RPM, the contact surfaces of the vanes are separated from the cam surface at the sealing arcs which precede the discharge arcs as well as the inlet and discharge arcs. To reduce centrifugal forces on the vanes, the vanes are made of a tough light plastic, such as Torlon, and are of a width which is as narrow as possible consonant with structural integrity and the free sliding of the vanes in their respective slots. Making the vanes narrow is not only important with respect to reducing the mass of the vane, but is also important with respect to reducing the fluid displacement of the vanes as they stroke over the cam. Without a narrow vane, the tips of the vanes would not be able to follow the cam contour over an inlet arc because of the fluid resistance to the radially inward movement thereof, this resistance being similar to that which opposes movement of a piston in a cylinder.

It should be noted that without the light narrow vane design, large powerful springs would be required behind the vanes. In most cases, such springs would be impractical because of space considerations and the fact that such springs exhibit a short fatigue life. Large powerful springs would also increase bearing loads on the vanes and be subjected to a greater diminution of bias force due to their greater mass. That is to say, a small spring is deprived of a smaller portion of its urging force at a given angular velocity than is a larger spring.

Accordingly, it is a primary object of the invention to provide a vane pump of the type having a stationary centrally disposed cam and an annular rotor with radially inwardly directed vanes wherein the vanes are adapted to separate from the cam surface at a high RPM for unloading the pump without the use of speed sensors and pressure relief valves.

Another object is to provide a fuel pump assembly for a gas turbine engine which incorporates a centrifugal pump and a vane pump in which the vane pump is automatically deactivated at a high RPM.

Still another object is to provide a vane pump of the type having stationary centrally disposed cam and an annular rotor with radially inwardly directed vanes wherein the vanes are hydraulically balanced, made of a tough light plastic and narrow in width, whereby only a small spring force is required to maintain the vanes in contact with the cam surface until a high RPM is attained.

These and other objects and advantages of the invention will become more readily apparent from the following detailed description, when taken in conjunction with the accompanying drawings, in which:

BRIEF DESCRIPTION OF THE DRAWINGS

FIG. 2A is a perspective view of a vane, per se, incorporated in the vane pump of FIG. 2.

FIG. 5 is a linear representation of the vane pump of FIGS. 1 and 2.

FIG. 6 is a graph showing the relationship between pump assembly discharge flow and pressure and pump speed.

DETAILED DESCRIPTION OF PREFERRED EMBODIMENT

Figure 1:
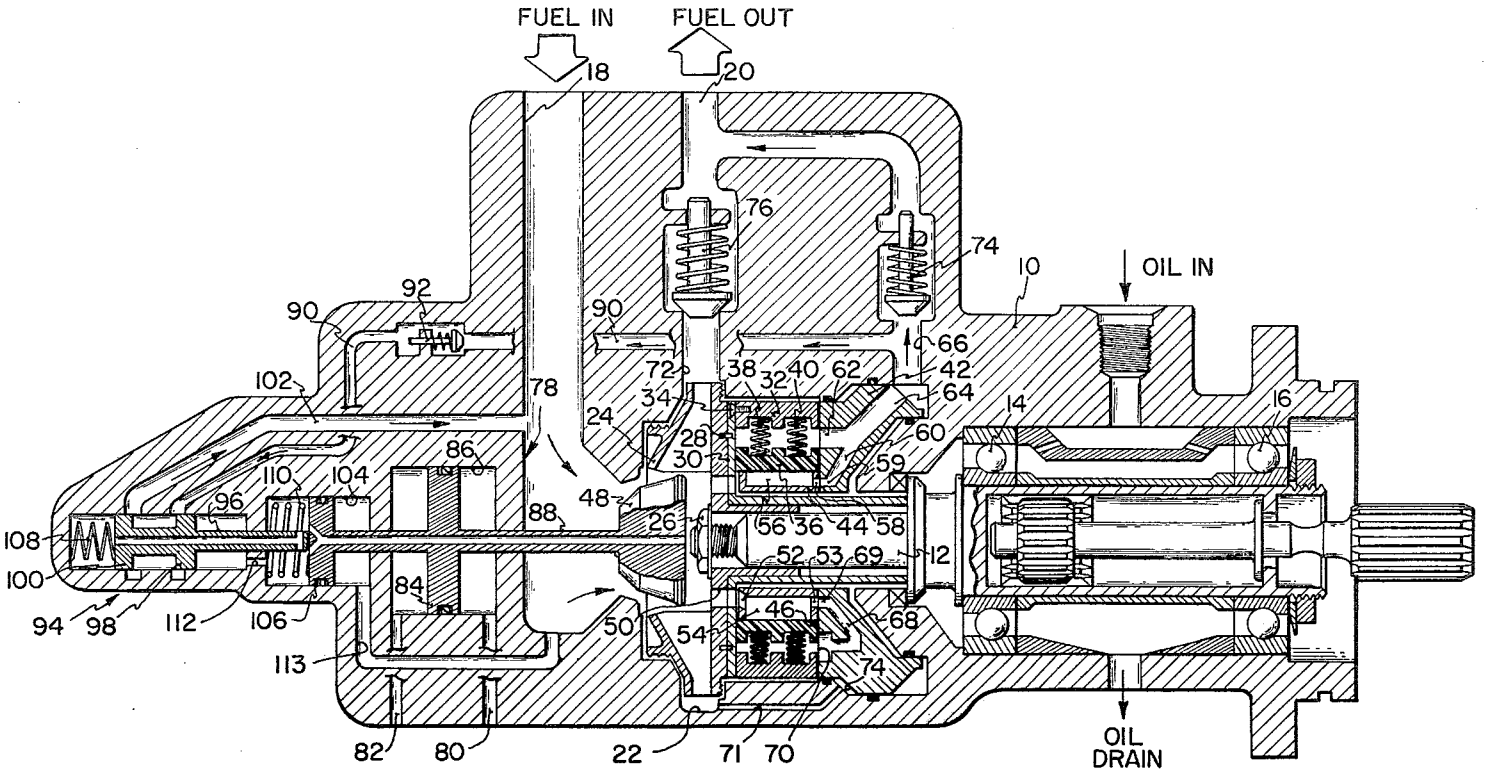
FIG. 1 is a schematic diagram of a pump assembly incorporating a vane pump of the invention.

Referring now to the drawings, wherein like numerals are used to designate like elements throughout the several figures, there is shown in FIG. 1 a schematic view of a pump assembly of the invention. The depicted pump assembly is adapted to fulfill starting and maximum flow requirements for a gas turbine engine (not shown). The pump assembly, which embodies a fixed displacement starting vane pump with a high speed centrifugal pump, employs inlet throttling to match the centrifugal pump flow at maximum engine speed with the engine turndown requirements. It will be understood that the pump assembly is adapted to vary output flow so as to hold a constant pressure head across a metering valve, such variations being effected by the bypassing of flow from the vane pump and subsequent inlet throttling of the centrifugal pump.

With reference to FIG. 1, the pump assembly comprises a plural cavity housing 10 having a drive shaft 12 mounted for rotation therein upon bearings 14 and 16. The housing 10 is provided with an inlet 18 and an outlet 20 which communicate with a pumping cavity 22 formed within the housing 10. Mounted within the pumping cavity 22, upon the end of the drive shaft 12, is an impeller 24. A nut 26 secures the impeller 24 to the end of the drive shaft 12. Attached to the backside of the impeller 24 by means of dowels 28 is a front sideplate 30 for the vane pump. The front sideplate 30, of course, rotates with the impeller 24. A rotor 32, having a plurality of radially inwardly directed slots, is connected to the front sideplate 30 via a plurality of screws 34. Within each slot of the rotor 32 is mounted a vane 36 which is biased radially inwardly by two compression springs 38 and 40. On the other side of the rotor a nonrotating rear sideplate 42, which is spring and pressure loaded against the rotor 32 and a centrally disposed cycloidal cam member 44, is mounted in the cavity 22. The cam member 44, which is fixedly secured to the rear sideplate 42 by means not shown in FIG. 1, provides an outer cam surface 46 over which the tips or contact surfaces of the vanes 36 travel in sealing engagement therewith. The rotor 32, cam member 44 and shaft 12 are, of course, disposed in a mutually coaxial relationship.

Figure 3:
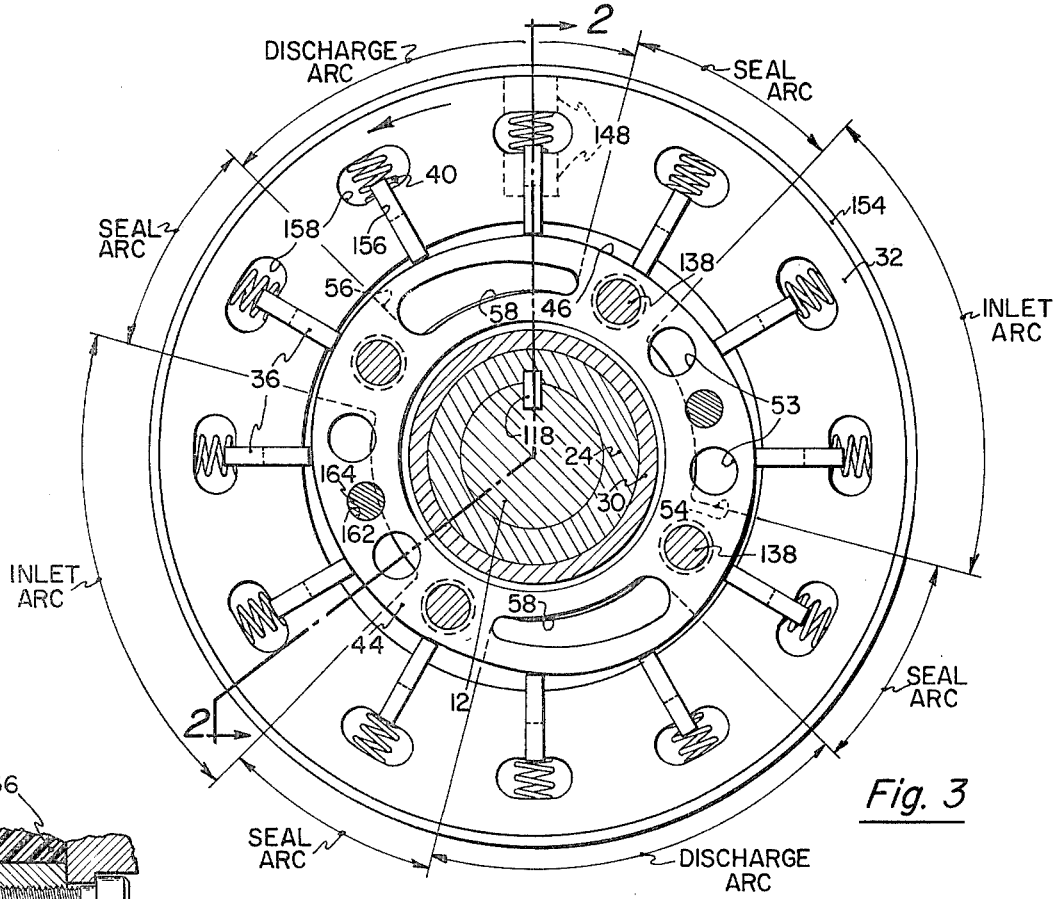
FIG. 3 is a rear end view of the rotor and cam of the pump assembly of FIG. 2, taken substantially along the line 3—3 thereof.

As the vanes 36 travel over the cam surface 46, they are displaced radially inwardly over the inlet arcs (shown hereinafter) by the springs 38 and 40 and displaced radially outwardly over the discharge arcs (shown hereinafter) by the cam surface. The intervane volume increases over an inlet arc and decreases over a discharge arc, whereby fuel is respectively received into and expelled from an intervane volume in the usual manner. Flow from the inlet 18 flows past a bell-shaped inlet throttling valve 48 into the eye of the impeller 24 and thence through a plurality of circumferentially distributed passages 50 in the back of the impeller 24 and the front sideplate 30 to two diametrically opposed inlet passages 52 in the cam member 44. There is a sufficient number of passages 50 in the impeller-sideplate structure to permit a passage 50 to be in communication with both of the inlets 52 and the cam member 44, irrespective of the angular position of the impeller 24. Communicating with the diametrically opposed inlet passages 52 in the cam member 44 are respective radial passages 54 which communicate with the intervane volumes at the cam surface to supply fluid thereto. Similarly, radially extending passages 56 in the cam member 44 receive fluid expelled from the intervane volumes over the discharge arcs and communicate with axially extending passages 58 in the cam member 44. The radially and axially extending discharge passages 56 and 58 in the cam member 44 are also diametrically opposed in the matter of the inlet passages, as is best shown in FIG. 3.

In order to hydraulically balance the vanes 36 in the radial direction, the radially outer surface of the vanes are generally referenced to the same pressure to which the radially inner tip of the vanes are referenced to. For example, in FIG. 1, the upper vane 36 is over a discharge arc of the cam member 44. Passages 59, 60, and 62 in the rear sideplate 42 function to communicate discharge pressure to the radially outer surface of the vane. As shown in FIG. 1, passages 60 and 62 join to form a sideplate discharge passage 64 which communicates with a vane discharge conduit 66. The lower vane, in the schematic view of FIG. 1, has its radially outer surface referenced to the inlet pressure to which the radially inner tip of the vane is exposed by communicating passages 70, 68, and 69 in the sideplate 42. Hence, it will be appreciated that while the vanes are over inlet and discharge arcs they are substantially hydraulically balanced, whereby the only force urging them radially inward is that force attributable to the springs 38 and 40.

Springs, which are not shown in the schematic view of FIG. 1, supplement the vane discharge pressure to maintain the sideplate 42 in contact with the rear end of the rotor. When the vanes 36 ultimately retract and the vane pump pressure decreases, discharge pressure from the impeller 24 drives the sideplate 42 away from the end of the rotor 32 to reduce friction and wear. As shown in FIG. 1, a conduit 71 in communication with an impeller discharge passage 72 directs impeller discharge pressure to an annulus 73 on the sideplate 42. The impeller discharge passage 72 communicates with the volute of the impeller 24 in the usual manner.

It will be seen the vane discharge passage 66 and the impeller discharge passage 72 are respectively provided with check valves 74 and 76 which communicate with the common pump assembly discharge passage 20. When the vane pump is operating, check valve 76 will be closed, thereby deadheading the impeller 24. However, as the vane flow decreases due to the vanes 36 disengaging from the cam member 44, both the vane and impeller pumps will supply flow whereby both check valves 74 and 76 will be simultaneously opened. As the vane pump completely unloads, check valve 74 will close and only the impeller pump will supply fuel to the engine via the discharge conduit 20.

The drive shaft 12 of the pump assembly of FIG. 1 is adapted to be connected to the gearbox of the gas turbine engine such that there is a correspondence between the speed of the engine and the speed of the vane pump and the impeller.

The vane pump is designed to supply fuel in excess of the requirements of the gas turbine engine so that a portion of the output thereof may be diverted, whereby the flow traversing the check valve 74 and exiting from the discharge passage 20 may be in conformance with the scheduled fuel flow for a given set of engine parameters such as engine speed, compressor discharge pressure, inlet air temperature, etc. To this end, an actuator 78 is operatively connected to the fuel control via servo control conduits 80 and 82. The actuator 78 comprises a piston 84 mounted for axial sliding movement within a cavity 86 and carried by a shaft 88. A bypass conduit 90, incorporating a bypass check valve 92 therein, connects the passage 66 upstream of check valve 74 with a vane pump bypass valve 94. The vane pump bypass valve 94 is constituted by a shaft 96 having two lands thereupon, 98 and 100, which define an annular volume that receives flow from the bypass conduit 90. The land 100 covers the entrance port to a continuation bypass conduit 102 which communicates directly with the inlet 18, thereby to complete the bypass loop. It will be seen that the shaft 96 extends into a cavity 104 in which is positioned a piston 106 mounted upon the end of the shaft 88. A spring 108 biases the vane pump bypass valve in the direction of the actuator such that the end of the shaft 96 always engages the left side of the piston 106. A second spring 110 urges the piston 106 and hence the actuator shaft 88 to the right. Carried on the right end of the shaft 88 is the inlet valve for throttling incoming flow to the impeller 24. Passages in the shafts 96 and 88 and a passage 112 in the housing 10 function to reference the outboard sides of the lands 98 and 100 to inlet pressure at the eye of the impeller and to reference the left side of the piston 106 to this pressure. The right side of the piston 106 is exposed to the pressure in the inlet passage 18 by means of the conduit 113.

During operation of the vane pump, the actuator strokes such that the amount of fuel bypassed back to the inlet by the vane pump bypass valve 94 is that amount which permits a constant head to be held across a metering valve (not shown). After the vane pump is unloaded and only the impeller pump supplies fuel to the engine, the actuator controls the position the inlet valve of the impeller pump to hold the same constant head across the metering valve. The throttling of the impeller pump inlet creates a core vapor to form in the eye of the impeller. The diameter of the core is determined by the downstream restriction while the position of the inlet valve determines the flow delivered. Impeller friction is moderated by operating the impeller partially in vapor, thereby conserving power and reducing fuel temperatures. Such pumps are known as vapor core pumps in the art and their mode of operation is well known.

Figure 2:
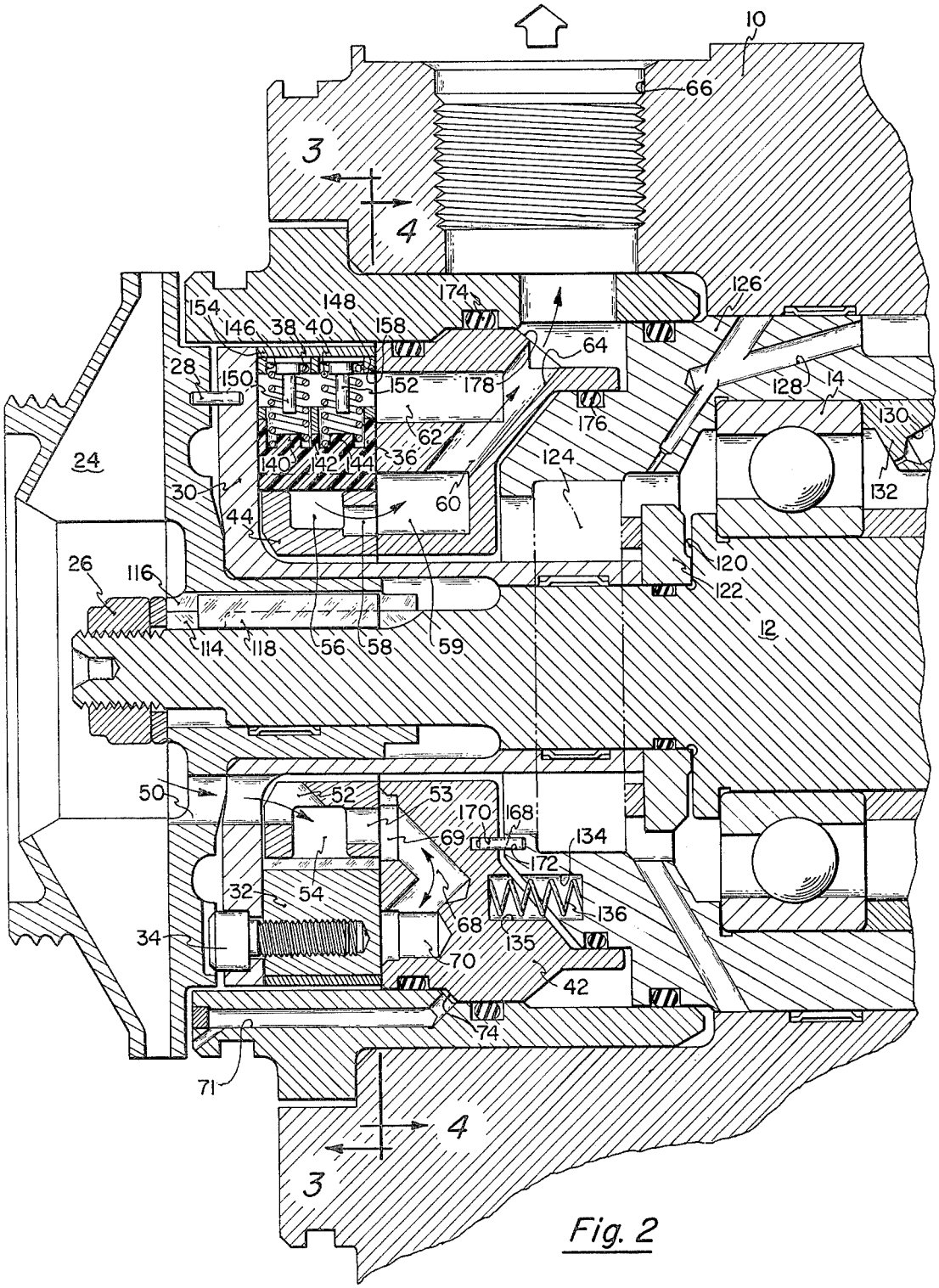
FIG. 2 is a fragmentary longitudinal sectional view of a preferred construction for the pump assembly of FIG. 1.

Referring now to FIG. 2, wherein a preferred construction for the pump assembly schematically depicted in FIG. 1 is illustrated, it will be noted that the drive shaft 12 and the impeller 24 have a pair of confronting slots 114 and 116 which receive a key 118, thereby establishing a driving connection therebetween. Between the front sideplate 30 and a shoulder 120 on the driveshaft 12 is positioned a seal face 122 which is engaged by a carbon faced seal 124, shown partially in phantom, fixedly positioned in a bearing retainer 126. The carbon faced seal 124 is necessary to prevent the inner mixing of fuel and oil, oil being applied to the bearing 14 via a lubrication passage 128 in the bearing retainer 126 and a lubrication passage 130 in a spacer 132 which is inserted between the upper races of the bearings 14 and 16. The bearing retainer 126 has a plurality of front facing axial cavities 134 which register with similar rear facing axial cavities 135 in the sideplate 42. Respective springs 136 are inserted in these cavities such that they extend therebetween for urging the sideplate 42 toward the rotor 32 and the cam member 44.

When impeller discharge pressure becomes sufficient, the pressure on the annulus 73 of the sideplate 42 overcomes the force exerted by the springs 136, whereby the sideplate 42 moves to the right or away from the rotor 32. Before this rightward movement of the sideplate 42 is occasioned, the vanes will have withdrawn from the surface of the cam member 44. Since the sideplate 42 is connected to the cam member 44 by means of a bolt 138 (FIG. 4A), the cam member 44 will also move to the right and, of course, move leftward with the sideplate 42 when the impeller discharge pressure drops sufficiently.

In the depicted pump assembly, it is not only desirable to remove the sideplate 42 from the rear surface of the rotor 32 after the vane pump is unloaded, but it is essential since most of the fuel will be sucked out of the cam member 44 and that portion of the cavity 22 which contains the vane pump by the low pressure in the eye of the impeller 24, this fuel passing through the passages 50 in the back of the impeller. The remaining portion of the fuel will be thrown radially outwardly through clearance spaces. Failure to withdraw the sideplate 42 from the rotor in the absence of lubricating fuel will result in unacceptable friction between the rotor 32 and the sideplate 42 which might beget structural damage. It will be appreciated by those skilled in the art that only a small space of the order of a fraction of an inch between the rotor 32 and sideplate 42 is required under such circumstances. The primary benefit obtainable by evacuating that portion of the pumping cavity which contains the vane pump is that reduced power is required to drive the pump since rotation of the rotor 32 will not be impeded by fuel.

From FIG. 2, it will be observed that the vanes 36 are provided with four slots in their radially outer portions which define projections 140, 142, and 144. The springs 38 and 40 respectively encircle the projections 140 and 144 and are seated in the slots adjacent thereto. The radially outer part of the rotor 32 embodies a plurality of sets of bores 146 and 148 for each vane 32. In the slots are positioned spring guides 150 and 152 in coaxial relationship with the springs 38 and 40, respectively. The guides 150 and 152 have enlarged diameter portions at their radially outer ends which function to seat the springs 38 and 40. In order to confine the guides 150 and 152 within the rotor 32, a ring 154 is mounted around the rotor in encircling relationship thereto.

Liquid fuel, which occupies that portion of the cavity 22 containing the positive displacement pump and which is not withdrawn via the passages 50 into the eye of the impeller during vapor core operation, will be centrifugally thrown outwardly between the sideplate 42 and the rotor 32, thereby causing the remaining liquid fuel to be directed to the impeller outlet passage 72. When the impeller is operating in a normal mode without a vapor core in the eye thereof, there will be no evacuation as heretofore described.

The geometry of the cam member 44 and its relationship to the rotor 32 is depicted in FIG. 3. The structural details of the rotor 32 which relate to the mounting of the vanes 36 may best be appreciated from FIG. 3 taken in conjunction with FIG. 2. Each vane 36 is slideably mounted in a radially extending slot 156 which axially extends completely through the rotor 32. The upper surface of the vanes 36 receive pressure via an axially extending passage 158 which extends through the length of the rotor. The bores 146 and 148 are continued in the radially inner portion of the rotor to furnish positioning for the springs 38 and 40. It will be noted that whatever pressure is communicated to the passage 158 will be applied to the radially outer surfaces of the vanes 36. It is important to note that the vane width as viewed from FIG. 3 should be as narrow as possible, but not so narrow as to cause the vanes to bind in the rotor slots 156 when a slide load is applied by discharge pressure. A graphite filled polyimide resin is a suitable material for the vanes because of its low density, good bearing qualities, and high operating temperature capability.

A cycloidal cam contour is preferred for the cam surface 46 of the cam member 44. The selection of such a contour for both the inlet arcs and discharge arcs is beneficial because it produces gradual changes in vane acceleration at the beginning and end of the discharge arcs and at the beginning and end of the inlet arcs. It is interesting to note that while the maximum acceleration of a parabolic cam is lower than that of a cycloidal cam, the sudden changes in acceleration at the start, mid and end portions of the cam could cause the vanes to lift off the cam prematurely, thereby producing high shock loads on the vanes. From FIG. 3 it will be seen that the cam incorporates two diametrically opposed discharge arcs and two diametrically opposed inlet arcs. The usual inner and outer seal arcs of respective constant radii join the inlet arcs and the discharge arcs. Fluid confined between an intervane volume which is traversing a discharge arc is expelled through the radially extending passage 56 and vents through the axially extending passage 58 which confronts the sideplate as best shown in FIG. 4. However, some of the fluid in the inner vane volume is expelled in an axial manner directly into the sideplate, although such a feature is not critical to a practice of the invention.

As shown in FIGS. 2 and 3, the axially extending passages 53 extend from the rear side of the cam member 44 to the radially extending passage 54. The passages 53 communicate with passages in the sideplate 42 which direct inlet pressure behind the vanes 36 as is set forth hereinafter in more detail. Also, the passages in the sideplate are similarly exposed to inlet pressure between an intervane volume over an inlet arc as is more clearly shown in FIG. 4. Between the passages 53 in the cam member 44 are provided pin holes 162 for receiving pins projecting from the sideplate to secure the proper alignment between the cam member 44 and the sideplate 42.

As FIG. 4 shows, the passage 59 which receives flow from the passage 58 in the cam member 44 is an elongated arcuate passage. The passage 62, which communicates with the passage 59 via passage 60, is also an elongated arcuate passage. Extending circumferentially from the extremities of the passage 62 are grooves **62*a* and 62*b* in the face of the sideplate 42 which are adapted to supply discharge pressure to the passages 158 over a portion of the seal arcs encompassed thereby. As the rotor 32 turns, an inlet 158, which is traversing the arc defined by 62*a*, 62 and 62*b*, is always in communication with discharge pressure. Even in that portion of the seal arc where the radially outer surface of a vane is exposed to discharge pressure, the vane is still somewhat hydraulically balanced because discharge pressure will be applied to approximately one half of the radially inner surface of the vane which engages the cam surface 46. As the vane traverses the remaining portion of the seal arc, the passage 158 becomes sealed from both discharge pressure and inlet pressure. The pressure in the passage 158** in this latter location, which is applied to the radially outer surface of the vane, is believed to lie somewhere between inlet pressure and discharge pressure.

As the vane approaches an inlet arc, the passage 158 will communicate with the passage 70 which is arcuate and elongated in the manner of the passage 62. As illustrated in FIG. 4, inlet pressure is applied to the passage 70 via two passages 69 (which each communicate with a passage 53 in the cam member 44) and the respective passages 68 indicated in dashed lines. After a vane 36 leaves an inlet arc, the passage 158 is temporarily sealed as it traverses the seal arc until it encounters the groove **62*b* which also occupies a portion of the seal arc. When this occurs, discharge pressure will again be ported to the passage 158, thereby directing discharge pressure to the radially outer surface of the vane 36. As a study of FIG. 4 will reveal, the discharge passages 59 not only communicate with the axial passages 58 but also communicate with an intervane volume. Similarly, the passages 69, which communicate with the respective passages 53**, also communicate with an intervane volume.

Figure 4A:
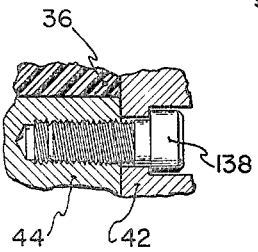
FIG. 4A is a longitudinal sectional view, taken substantially along the line 4A—4A of FIG. 4 and showing the connection between the cam member and the rear sideplate.
Figure 4:
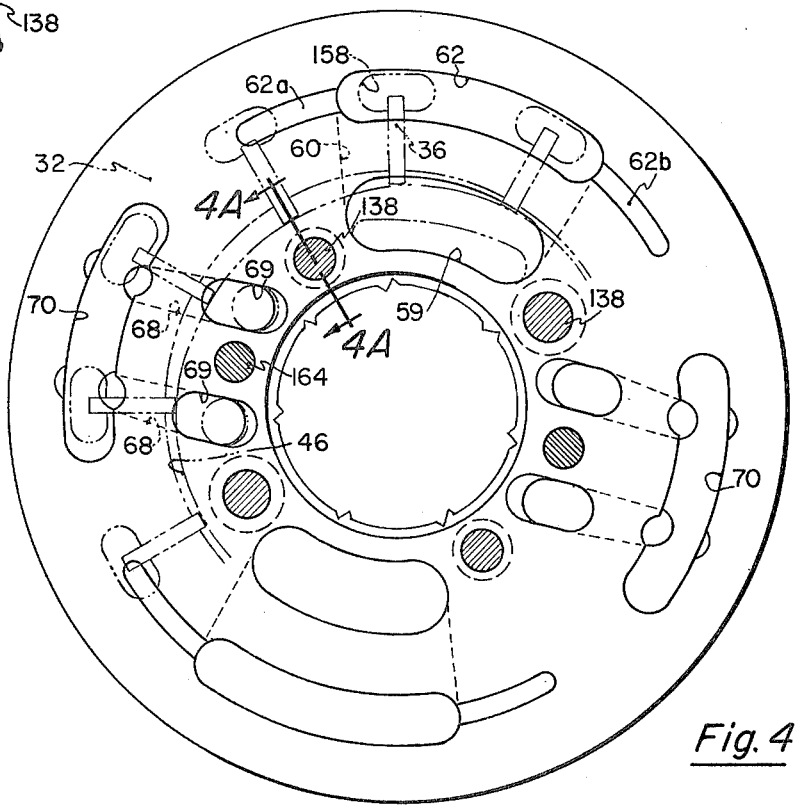
FIG. 4 is a front end view of the rear sideplate, taken substantially along the line 4—4 of FIG. 2, with the confronting rotor, vanes and cam member partially shown in phantom.

With reference to FIGS. 2 and 4A, the bolt 138 interconnects the sideplate 42 and the cam member 44 such that when the sideplate moves to the right or away from the rotor 32, the cam member 44 travels with the sideplate 42. Neither the sideplate 42 nor the cam member 44 will have a tendency to rotate with the rotor 32 by virtue of a plurality of pins 168 which are received in aligned cavities 170 and 172 in the sideplate 42 and the bearing retainer 126, respectively. The pins 168, of course, allow axial movement to permit the sideplate 42 to withdraw from the rotor 32. However, the left or front side of the cam member 44, which is adjacent the front rotating sideplate 30, is always spaced therefrom by a small distance even when the rear sideplate 42 engages the rotor 32. This small clearance between the front sideplate 30 and the cam member 44 causes a small amount of internal leakage; and such leakage must be taken into consideration in sizing the vane pump. As shown in FIG. 2, O-ring seals 174 and 176, respectively located on the O.D. and I.D. of the sideplate 42, contain discharge pressure from the vane pump which acts on the annulus 178 to furnish the required pressure loading for supplementing the force of the springs 136. Hence, the sideplate 42 is urged into the rotor by the springs 136 and the pressure acting on the annulus 178 thereof and is urged away from the rotor by the pressure acting on the annulus 73 which is exposed to impeller discharge pressure.

By way of example, a pump assembly of the invention has been shown and described as a fuel pump adapted to supply fuel to a gas turbine engine. In the illustrated pump assembly, the vane stage exclusively furnishes flow until a rotational speed is attained at which the impeller pump can develop sufficient pressure to satisfy the engine fuel flow requirements. Assuming, for example, that the centrifugal pump develops sufficient pressure at 45% engine speed, it is desirable to have the vanes retract from the cam at this speed. Obviously, early vane retraction minimizes the wear of the bearing surfaces of the vanes and the cam member. For the purpose of illustration, it will be assumed that the vane pump must be operable up to 12,000 RPM and must be completely unloaded by 15,000 RPM.

In a pump assembly of the invention, the vanes will tend to first lift off the cam surface of the cam member at the two inlet arcs since only the spring force is urging the vane toward the cam surface which is retreating from the tip of the vane. With reference to FIG. 5, wherein a linear representation of the cam and rotor is presented, it will be appreciated that if a vane which separates from the cam surface over an inlet arc does not reseat on a sealing arc, the vane pump will unload at an earlier than desired RPM. A solution to this problem is not the use of heavier springs since space and structural considerations will normally prohibit their inclusion. It also should be noted that the centrifugal force which tends to throw the vanes away from the cam surface also acts on the springs so as to reduce the bias provided thereby. Aside from keeping the vanes on the cam surface of the cam member with a larger and more powerful spring, an alternative solution would be to direct discharge pressure behind the vanes over an inlet arc and, as previously mentioned, this mandates the utilization of suitable valving and sensors thereby increasing the complexity of the pumping assembly. What is desired then is to insure that a vane can follow the cam surface over an inlet arc up to near the required deactivation RPM. Alternatively, if in the best possible design, the vanes separate from the cam surface over an inlet arc well before the deactivation RPM, such a design must permit the vanes to reseat on a sealing arc before passing to a discharge arc up to the deactivation RPM. It is noteworthy that, if the vanes reseat on the adjacent sealing arc somewhere near the beginning thereof, there is practically no diminution of pump output. A pump assembly of the invention may then have to be designed to allow a small spring force to reseat a vane which has separated from the cam surface back on the cam surface at a sealing arc.

The spring force required to hold the vanes on the cam surface of the cam member may be determined by consideration of two acceleration forces: 1. vane acceleration due to rotation around the cam surface; and 2. radial vane acceleration along the cam surface. These two acceleration forces which influence vane retraction, act on three masses: 1. vane mass; 2. fluid mass in the vane passages; and 3. spring mass. The centrifugal force of the vanes is expressed by the following equation for uniform angular velocity:

$$F = mrw^2 \tag{1}$$

wherein:

F = centrifugal force;

m = mass of the vane;

r = radius to the center of gravity of the vane; and w = angular velocity of the rotor.

While the fluid pressure within the passages 158 to which the radially outer surface of each vane is exposed will oppose the forces tending to drive the vane radially outwardly, it should be borne in mind that this pressure on the radially outer surface of the vane is progressively diminished as RPM increases due to centrifugal force. Hence, the springs must oppose the vane centrifugal force and the force engendered by the pressure differential thereacross. It should also be noted that the centrifugal force acting on each spring coil contributes to a reduction in the force exerted by the springs on a vane. However, since each coil is at a slightly different radius, calculation of the spring force reduction by centrifugal force requires the simultaneous solution of the following differential equations:

$$\frac{dF}{dr} = \infty\,(r + u)\,\frac{M}{L}\,W^2 \tag{2}$$

wherein:

u = radial displacement at r; and

L = installed length of spring;

and $$\frac{du}{dr} = \frac{F}{KL} \tag{3}$$

wherein:

K = the spring constant.

For purposes of this solution, the inner and outer coils may be considered to remain stationary. For a particular pump which has been built and tested, solution of the above equations indicated that the loss of force was equal to 48% of the centrifugal force of the spring. The centrifugal force of the spring is calculated by equation one using as the radius for the spring mass, a point midway between the ends of the springs. This approximation results in an error of only about 1%t. It will then be seen that the total static spring force required for the rotatitonal acceleration loads is equal to the vane centrifugal force plus 48% of the spring centrifugal force fot this particular pump.

Over an inlet arc the vanes must accelerate inwardly if they are to remain in contact with the cam surface. This inward vane acceleration is opposed by the fluid which must be displaced by the vane during inward movement. As noted previously, no flow loss will occur if the vanes lift off and reseat on the cam surface before the start of the sealing arcs. Therefore, in the design of a pump assembly of the invention, it is essential to determine if the vanes will reseat on the cam surface at or before the start of a sealing arc prior to the specified deactivation speed. Fluid must be displaced by the vanes under the urging of the springs in order for the radially inner surface of the vane to return to an inlet arc. In essence, the vanes act as pistons, pushing the fluid through passages in the rear sideplate into the slots 158 in the rotor 32. It is important to note that such fluid inertia resists inward vane acceleration urged by the springs. It is therefore necessary to size the spring such that once a vane departs from the cam surface over an inlet arc, it returns to that cam surface before reaching the sealing arc. In FIG. 5, the paths of the vane tips for various RPM's are indicated in dashed lines. As the separated vanes re-engage the cam surface progressively further down the sealing arc, pump output will accordingly progressively decrease. By making the vanes thin and light to respectively minimize centrifugal forces and fluid resistance to inward movement of the vane, a small spring with a relatively long fatigue life can be employed.

It is possible to analytically determine the range of RPM's at which a vane will lift off the cam surface but reseat thereupon at or before the beginning of a sealing arc. A relationship between the spring force available and the other forces acting on the vane can be written to establish the radial vane acceleration and radial travel while the vane is off the cam surface during rotation over an inlet arc. The force required to accelerate a vane can be expressed as follows:

$$F_v = M_v a_v \tag{4}$$

wherein:

$F_v$=the radially inward force applied to a vane;
$M_v$=the mass of a vane; and
$a_v$=the radial acceleration of a vane.

The force required to accelerate the fluid can be analyzed by considering the vane as a piston displacing the fluid through two restrictions of different areas, that is, the area of the vane slot and the area of the connecting passage. The resulting pressure differential on the vane is expressed as follows:

$$\Delta P = M_f\left(\frac{A_v}{A_p^2}\right) a_v \tag{5}$$

wherein:

$\Delta P$=the radial differential pressure acting on the vane;
$M_f$=the mass of displaced fluid;
$A_v$=the area of the vane slot; and
$A_p$=the area of the interconnecting passage.

The force ($F_f$) required by the vane to accelerate the fluid is:

$$F_f = \Delta P A_v \tag{6}$$

$F_f$=the resultant fluid force acting on the vane.

Equation (6) can be expressed in terms of the radial vane acceleration by substituting equation (5) in equation (6) as follows:

$$F_f = M_f\left(\frac{A_v}{A_p^2}\right) a_v A_v \tag{7}$$

The total acceleration forces acting on the vane is the sum of equations (4) and (7):

$$F_T = M_v a_v + M_f\left(\frac{A_v^2}{A_p^2}\right) a_v \tag{8}$$

wherein:

$F_T$=the resultant total force acting on the vane.

Equation (8) defines the relationship between the radial vane acceleration and the remaining spring force after subtracting the centrifugal force. The incremental vane travel per increment of time while the vane is off the cam, assuming constant acceleration over the time interval, is determined by the following equation:

$$s = s_o + v_o \Delta t + \tfrac{1}{2} a_o (\Delta t)^2 \tag{9}$$

wherein:

s=the radial vane displacement;
$s_o$=the initial radial vane displacement;
$v_o$=the initial vane velocity;
$a_o$=the initial radial vane acceleration; and
$\Delta t$=the time interval.

However, with respect to equation (9), since the spring force is constantly decreasing as the vane moves towards the cam surface, the vane acceleration continues to decrease thereby requiring an iterative solution of the equation. The initial conditions are determined by the velocity and acceleration equations for a cycloidal cam since the spring force over the first few degrees is sufficient to keep the vane on the cam surface:

$$S_o = \frac{S_t}{2\pi}\left(\frac{2\pi\theta}{\beta} - \sin\frac{2\pi\theta}{\beta}\right) \tag{10}$$

wherein:

$S_t$=the total radial cam rise;
$\phi$=the angular rotation over the cam surface; and
$\beta$=the angular rotation for the total cam rise.

$$V^\circ = w\frac{S_t}{\beta}\left(1 - \cos\frac{2\pi\theta}{\beta}\right) \tag{11}$$

$$a^\circ = w^2\left(\frac{2\pi S_t}{\beta^2}\sin\frac{2\pi\theta}{\beta}\right) \tag{12}$$

The velocity of the vane at the end of each incremental motion is, of course, as follows:

$$V = V_o + a_o \Delta t \tag{13}$$

A computer program may be easily prepared to furnish iterative solutions to equations (2) and (3) which reflect the spring force that alone functions to accelerate the vanes inwardly and to equations (8) and (9) which relate vane acceleration and radial distance travel to the spring force. Such a program should provide solutions for each fraction of a degree rotation, e.g., 0.2°. It should be apparent that by using various spring vane masses in initial starting conditions, a pump of the invention may be designed in a facile manner. It should be remembered that for a particular set of pump parameters, when the vanes reseat on the cam surface just at the start of a sealing arc, pump output will not be diminished. A computer study as described will give insight into the RPM range in which deactivation proceeds.

In operation, as the gas turbine engine is started, the shaft 12 begins to turn, thereby producing rotation of rotor 32 and the impeller 24. The vane stage furnishes the dry lift necessary to enable fuel to be sucked from inlet 18 through the passages 50 in the impeller into the passages 52 in the cam member 44 from whence it proceeds to the inner vane volumes traversing an inlet arc. The inlet throttling valve 48 performs no function whatsoever at this stage since fuel from the inlet 18 merely flows therearound into the passages 50. Initially at starting, the springs 38 supply the only force serving to hold the vanes 36 on the cam surface 46. As the vane stage begins to develop discharge pressure in passage 66, the check valve 74 cracks open whereby fuel flows to the discharge conduit 20 and thence to the burner nozzles of the gas turbine engine. The fuel control which senses various engine parameters positions a metering valve across which a constant pressure head is maintained, whereby metered flow is a function of only metering valve position. The piston 84 will be positioned in such a manner that the amount of fuel bypassed is varied to hold a constant pressure head across the metering valve, which is downstream of the outlet 20. Positioning of the piston 84 will, of course, produce a corresponding movement of the inlet throttling valve 48. But, here again, this has no effect on flow entering the vane stage.

With reference to FIG. 4, it will be appreciated that over portions of the sealing arcs the radially outer ends of the vanes 36 are exposed to discharge pressure and that over other portions of the sealing arcs, the passages 158 in the rotor 32 are sealed such that some pressure intermediate discharge pressure and inlet pressure exists. It should be noted that over the sealing arcs when a vane 36 leaves an inlet arc, the pressure in passage 158 is momentarily sealed therein until the vane travels about halfway across the sealing arc whereupon the passage 158 is exposed to discharge pressure. Since the pressure on the contact surface of a vane traversing a sealing arc is constituted by inlet pressure on one side thereof and discharge pressure on another side thereof (assuming point contact with the cam surface), the resultant pressure forces acting on the vane urge the vane outwardly over the first half of the sealing arc and inwardly over the latter half of the sealing arc. However, when a vane leaves a discharge arc, the passage 158 is exposed to discharge pressure for about half the distance of the suceeding sealing arc, whereupon the passage 158 is sealed for the remaining distance of the sealing arc. Thus, as the vane proceeds from a discharge arc to an inlet arc the hydraulic pressure imbalance on the vane should urge the vane inwardly toward the cam surface. It will therefore be appreciated that immediately before entering and immediately after leaving a discharge arc, the radial pressure imbalance on the vane will tend to urge it into contact with the cam surface, thereby to provide adequate sealing in the sealing arc portions adjacent the discharge arcs.

Although the impeller 24 turns with the rotor 32, the vane stage will develop more pressure in conduit 66 than the impeller will develop in conduit 72, thereby causing the check valve 76 to remain closed whereby the discharge from the impeller 24 is deadheaded. As engine speed continues to increase, the pressure in conduit 72 increases but not an amount sufficient to overcome the increased pressure in conduit 66, whereby the valve 76 remains closed. As the engine speed continues to increase, the radially inward resultant force on the vane (which tends to maintain the vanes in contact with the cam surface 46) continues to decrease due to the centrifugal force acting on the vanes. Eventually this force is reduced to a point where the vanes cannot accelerate sufficiently radially inwardly to maintain their contact surfaces in engagement with the inlet arcs. At this point, the contact surfaces of the vanes disengage from the inlet arcs but reseat thereupon before reaching the adjacent sealing arc. Since the vanes reseat before reaching the adjacent sealing arc, the output of the vane stage will remain substantially undiminished. As shown in FIG. 5 in dashed lines, as engine speed increases the contact surfaces of the vanes will disengage earlier from the inlet arc and reseat progressively further along the adjacent sealing arc, thereby causing progressive flow reduction. This flow diminution will continue with increasing engine speed until the vanes reseat on the discharge arc without engaging the sealing arc.

With reference to FIG. 6, it may be seen that the flow from the vane stage increases with engine speed until a speed slightly over 12,000 RPM is attained as engine speed then continues to increase the vanes seat progressively further down the sealing arc. The vane flow then decreases as shown in the dashed line until the vanes reseat on the discharge arc beyond the sealing arc at about 15,000 RPM whereupon the vane stage output is zero. As the output flow of the vane stage initially decreases, valve 76 cracks open whereby the impeller 24 commences to supply flow to the discharge conduit 20. As the vane output flow further decreases, impeller flow accordingly increases such that the total discharge flow from the pump assembly continues to increase with increasing RPM. As FIG. 6 clearly shows, the pump assembly discharge flow is always increasing with RPM, as is the discharge pressure of the pump assembly. After the vanes 36 no longer seat on a sealing arc after disengaging from the adjacent inlet arc, only the impeller supplies fuel to the engine via conduits 72 and 20, check valve 74 being closed. As the engine speed continues to increase, the discharge pressure of the impeller, which is now the discharge pressure of the pump assembly, increases, with the output of the impeller being controlled by the throttling valve 48, in accordance with pressure signals generated by the fuel control. The discharge pressure of the impeller, which is transmitted to the annulus 73 via the duct 71, produces a rightward axial movement of the sideplate 42 together with the cam member 44 to which it is attached. With increasing speed, although the vane stage was previously unloaded, the vanes continue to retract radially outwardly contacting the discharge arc at progressively further radial distances. Eventually the engine attains a speed (which should preferably be below the idle speed of the engine) where the vanes are completely withdrawn from the cam surface at all inlet, discharge, and sealing arcs. At idle speed, it will be noted that the friction which the rotating rotor 32 encounters is minimal since the sideplate 42 has been withdrawn therefrom and the vanes 36 no longer engage the cam surface. In addition, fluid resistance to rotation of the rotor 32 will be minimized since the vapor core, which was formed in the eye of the impeller 24 as idle speed was attained, has evacuated the liquid fuel from the radially inner portion of the pumping cavity in which the vane stage is mounted, the remainder of the fuel being expelled outwardly through the clearance between the sideplate 42 and the rotor 32 and through the clearance between the rotor 32 and the housing. Hence, at idle speed, the drag of the rotor 32 does not unduly burden the engine.

As the engine accelerates from idle speed, the inlet throttling valve 48 is stroked in accordance with the pressure signals generated by the fuel control such that a constant head is maintained across the metering valve which receives flow from the conduit 20 and delivers it to the burner nozzles of the engine. At operation above idle, that portion of the cavity containing the vane stage remains evacuated and the sideplate 42 remains spaced from the rotor.

Obviously, many modifications and variations are possible in light of the above teachings without departing from the scope and spirit of the invention as defined in the following claims.

We claim:

1. In an improved fluid pump assembly of the type comprising: a housing having a pumping cavity means therein; an impeller mounted for rotation within the pumping cavity means for generating fluid pressure; an annular rotor, having a plurality of inwardly facing radial slots, mounted for rotation within the pumping cavity means and drivingly connected to the impeller; a cam member, having a cam surface on the outer periphery thereof, mounted in the pumping cavity means in fixed angular relationship thereto such that the cam surface is disposed radially inwardly of the inner periphery of the rotor, the cam surface defining in the direction of rotor rotation at least one inlet arc of progressively decreasing radial distance and at least one discharge arc of progressively increasing radial distance with a sealing arc of constant radius therebetween which begins where the inlet arc terminates and terminates where the discharge arc begins; a plurality of vanes respectively mounted in the slots for radial inward and outward movement, the radially inner end of each vane having a contact surface adapted to slidingly engage the cam surface during rotation of the rotor;

spring means to urge the vanes radially inwardly toward the cam surface; the improvement comprising:

the radially inner and outer ends of each vane being shaped such that each vane is substantially in static hydraulic balance in a radial direction when the ends thereof are subjected to the same fluid pressure, the vanes being of narrow width when viewed in a cutting plane perpendicular to the axis of rotation of the rotor and being made of a tough light plastic material, whereby the fluid resistance to a vane moving radially inwardly is minimized and the centrifugal force on a vane is reduced which lessens the forces which must be exerted by the spring means to keep the vanes in engagement with the inlet arc and the sealing arc;

means to direct the same fluid pressure to the radially inner and outer ends of each vane while the vane is traversing an inlet arc for effecting static hydraulic balance in a radial direction; and whereby the lowest rotor speed at which the contact surfaces of the vanes fail to engage the sealing arc immediately prior to traversing a discharge arc is predictable and essentially independent of fluid pressure.

2. The improvement, as defined in claim 1, wherein the fluid pressure directing means comprises:

a sideplate mounted in the cavity means in fixed angular relationship thereto adapted to engage a side of the rotor and a side of the cam member, the sideplate having a plurality of passages for directing fluid pressure in intervane volumes in discharge arcs and inlet arcs to the radially outer ends of the vanes; and means for urging the sideplate against the side of the rotor.

3. The improvement, as defined in claim 2, wherein the sideplate urging means comprises:

a surface portion of the sideplate exposed to the pressure of fluid discharged from intervane volumes passing over a discharge arc; and a spring seated in the housing and the sideplate.

4. The improvement, as defined in claim 2, wherein the cam member and the sideplate are mounted for axial movement away from and toward the rotor; and wherein the improvement further comprises:

means to fixedly connect the sideplate to the cam member such that axial movement of the sideplate results in a corresponding axial movement of the cam member and relative rotation between the sideplate and cam member is prevented; and means to move the sideplate away from the rotor when the force exerted on the sideplate by the urging means is sufficiently reduced whereby friction between the rotor and the sideplate is eliminated.

5. The improvement, as defined in claim 1, wherein the fluid pump assembly is of the type further comprising:

an inlet throttling valve mounted in the cavity means for throttling flow entering the center of the impeller; and wherein the impeller includes:

impeller passage means to permit fluid from adjacent the cam member to be sucked into the center of the impeller when a vapor core is formed therein by throttling the entering flow.

6. The improvement, as defined in claim 5, wherein the fluid pump assembly is of the type in which the cam member comprises:

inlet supply passage means for directing incoming fluid to the intervane volumes traversing the inlet arc; and wherein the improvement further comprises:

the impeller passage means also serving to carry incoming fluid to the inlet supply passage means before formation of the vapor core.

* * * * *